US009622334B2

(12) United States Patent
Hashimoto

(10) Patent No.: US 9,622,334 B2
(45) Date of Patent: Apr. 11, 2017

(54) CYCLOTRON AND SUPERCONDUCTIVE ELECTROMAGNET

(71) Applicant: Sumitomo Heavy Industries, Ltd., Tokyo (JP)

(72) Inventor: Atsushi Hashimoto, Kanagawa (JP)

(73) Assignee: Sumitomo Heavy Industries, Ltd., Tokyo (JP)

( * ) Notice: Subject to any disclaimer, the term of this patent is extended or adjusted under 35 U.S.C. 154(b) by 0 days.

(21) Appl. No.: 15/097,881

(22) Filed: Apr. 13, 2016

(65) Prior Publication Data

US 2016/0316552 A1 Oct. 27, 2016

(30) Foreign Application Priority Data

Apr. 22, 2015 (JP) ..... 2015-087649

(51) Int. Cl.
*H05H 13/00* (2006.01)
*H01F 6/06* (2006.01)

(52) U.S. Cl.
CPC ..... *H05H 13/005* (2013.01); *H01F 6/06* (2013.01)

(58) Field of Classification Search
CPC ..... H05H 13/005; H01F 6/06
USPC ..... 313/62
See application file for complete search history.

(56) References Cited

U.S. PATENT DOCUMENTS 4,641,104 A * 2/1987 Blosser ..... H05H 7/20 250/493.1
4,883,968 A * 11/1989 Hipple ..... H01J 27/18 250/423 R
7,656,258 B1 * 2/2010 Antaya ..... H01F 6/00 313/62
8,836,205 B2 * 9/2014 Hashimoto ..... H05H 13/005 313/47
2014/0354190 A1 * 12/2014 Kleeven ..... H05H 13/005 315/502

FOREIGN PATENT DOCUMENTS

JP H05-259515 A 10/1993
JP 2014-086457 A 5/2014

* cited by examiner

*Primary Examiner* — Donald Raleigh
(74) *Attorney, Agent, or Firm* — Michael Best & Friedrich LLP

(57) ABSTRACT

A cyclotron includes a pole; a superconductive coil wound so as to cover an outer periphery of the pole; a coil support that supports the superconductive coil; a cooling part that cools the superconductive coil; a first support that is connected to the coil support and is capable of adjusting a position of the coil support in a direction of a winding central axis of the superconductive coil; and a second support that is connected to the coil support and is capable of adjusting the position of the coil support in an orthogonal direction orthogonal to the direction of the winding central axis of the superconductive coil. The second support has a link mechanism that is displaceable in each of the direction of the winding central axis and the orthogonal direction.

4 Claims, 5 Drawing Sheets

CYCLOTRON AND SUPERCONDUCTIVE ELECTROMAGNET

RELATED APPLICATIONS

Priority is claimed to Japanese Patent Application No. 2015-087649, filed Apr. 22, 2015, the entire content of which is incorporated herein by reference.

BACKGROUND

Technical Field

Certain embodiments of the invention relate to a cyclotron and a superconductive electromagnet.

Description of Related Art

In the related art, for example, Japanese Unexamined Patent Application Publication No. 2014-086457 is known as a technique in such a field. A cyclotron described in Japanese Unexamined Patent Application Publication No. 2014-086457 includes a vacuum vessel, superconductive coils arranged inside the vacuum vessel, and a coil support that supports superconductive coils. In this cyclotron, a magnetic field is generated inside the vacuum vessel by the superconductive coils, and a magnetic field is exerted on charged particles.

For example, a beam generated by the charged particles can be adjusted by adjusting the magnetic field generated with the superconductive coils. In order to adjust the magnetic field generated by the superconductive coils, the positions of the superconductive coils are required to be adjusted with high precision.

An object of the invention is to provide a cyclotron and a superconductive electromagnet with improved precision of the positional adjustment of a superconductive coil.

SUMMARY

According to an embodiment of the present invention, there is provided a cyclotron of the invention including a pole; a superconductive coil wound so as to cover an outer periphery of the pole; a coil support that supports the superconductive coil; a cooling part that cools the superconductive coil; a first support that is connected to the coil support and is capable of adjusting a position of the coil support in a direction of a winding central axis of the superconductive coil; and a second support that is connected to the coil support and is capable of adjusting the position of the coil support in an orthogonal direction orthogonal to the direction of the winding central axis of the superconductive coil. The second support has a link mechanism that is displaceable in each of the direction of the winding central axis and the orthogonal direction.

Since this cyclotron includes the coil support that supports the superconductive coil, and the first support that performs positional adjustment in the direction of the winding central axis of the superconductive coil, the coil support can be positionally adjusted in the direction of the winding central axis by the first support. Since this cyclotron includes the second support that positionally adjusts the coil support in the orthogonal direction orthogonal to the direction of the winding central axis of the superconductive coil, the coil support can be positionally adjusted in the orthogonal direction by the second support. Additionally, since the second support has the link mechanism that is displaceable in each of the direction of the winding central axis and the orthogonal direction, the coil support can be supported so as to follow the displacement in the direction of the winding central axis, and the second support can be displaced in the orthogonal direction. Therefore, the coil support can be positionally adjusted in the direction of the winding central axis of the coil and its orthogonal direction, and the precision of positional adjustment of the superconductive coil can be improved.

Additionally, the cyclotron may be configured to further include a fixing part that is fixed relative to the pole; and a positioning part that positions one end side of the second support with respect to the fixing part. According to the cyclotron having this configuration, as the second support is positioned with respect to the fixing part, the coil support is positionally adjusted in the direction orthogonal to the direction of the winding central axis.

The link mechanism may be configured to include a first direction member that extends in a first direction, a pin member that is coupled to one end side of the first direction member and extends in a second direction orthogonal to the first direction, a spherical shaft that is coupled to the other end side of the first direction member, extends in the second direction, and has a spherical surface, and a spherical bearing part that has an abutting surface abutting against the spherical surface and receives the spherical shaft. In this configuration, since the link mechanism includes the first direction member and the first direction member is coupled to the pin member extending in the second direction, the first direction member can be displaced around the axis extending in the second direction. Additionally, since the first direction member extends in the second direction and is coupled to the spherical shaft having the spherical surface, the first direction member can be displaced around the axis extending in the second direction and displaced around the axis extending in the first direction. Accordingly, the coil support can be positionally adjusted in the direction of the winding central axis of the superconductive coil and the orthogonal direction while supporting the coil support in response to the inclination of the coil support.

A superconductive electromagnet of the invention includes a superconductive coil wound around a winding central axis; a coil support that supports the superconductive coil; a cooling part that cools the superconductive coil; a first support that is connected to the coil support and is capable of adjusting a position of the coil support in a direction of the winding central axis of the superconductive coil; and a second support that is connected to the coil support and is capable of adjusting the position of the coil support in an orthogonal direction orthogonal to the direction of the winding central axis of the superconductive coil. The second support has a link mechanism that is displaceable in each of the direction of the winding central axis and the orthogonal direction.

Since this superconductive electromagnet includes the first support that positionally adjusts the coil support that supports the superconductive coil, in the direction of the winding central axis of the superconductive coil, the coil support can be positionally adjusted in the direction of the winding central axis by the first support. Since this superconductive electromagnet includes the second support that positionally adjusts the coil support in the orthogonal direction orthogonal to the direction of the winding central axis of the superconductive coil, the coil support can be positionally adjusted in the orthogonal direction by the second support. Additionally, since the second support has the link mechanism that is displaceable in each of the direction of the winding central axis and the orthogonal direction, the coil support can be supported so as to follow the displacement in the direction of the winding central axis, and the second support can be displaced in the orthogonal direction. Therefore, the coil support can be positionally adjusted in the direction of the winding central axis of the coil and its orthogonal direction, and the precision of positional adjustment of the superconductive coil can be improved.

According to the invention, the cyclotron and the superconductive electromagnet capable of positionally adjusting the superconductive coil with high precision can be provided.

DETAILED DESCRIPTION

Figure 1:
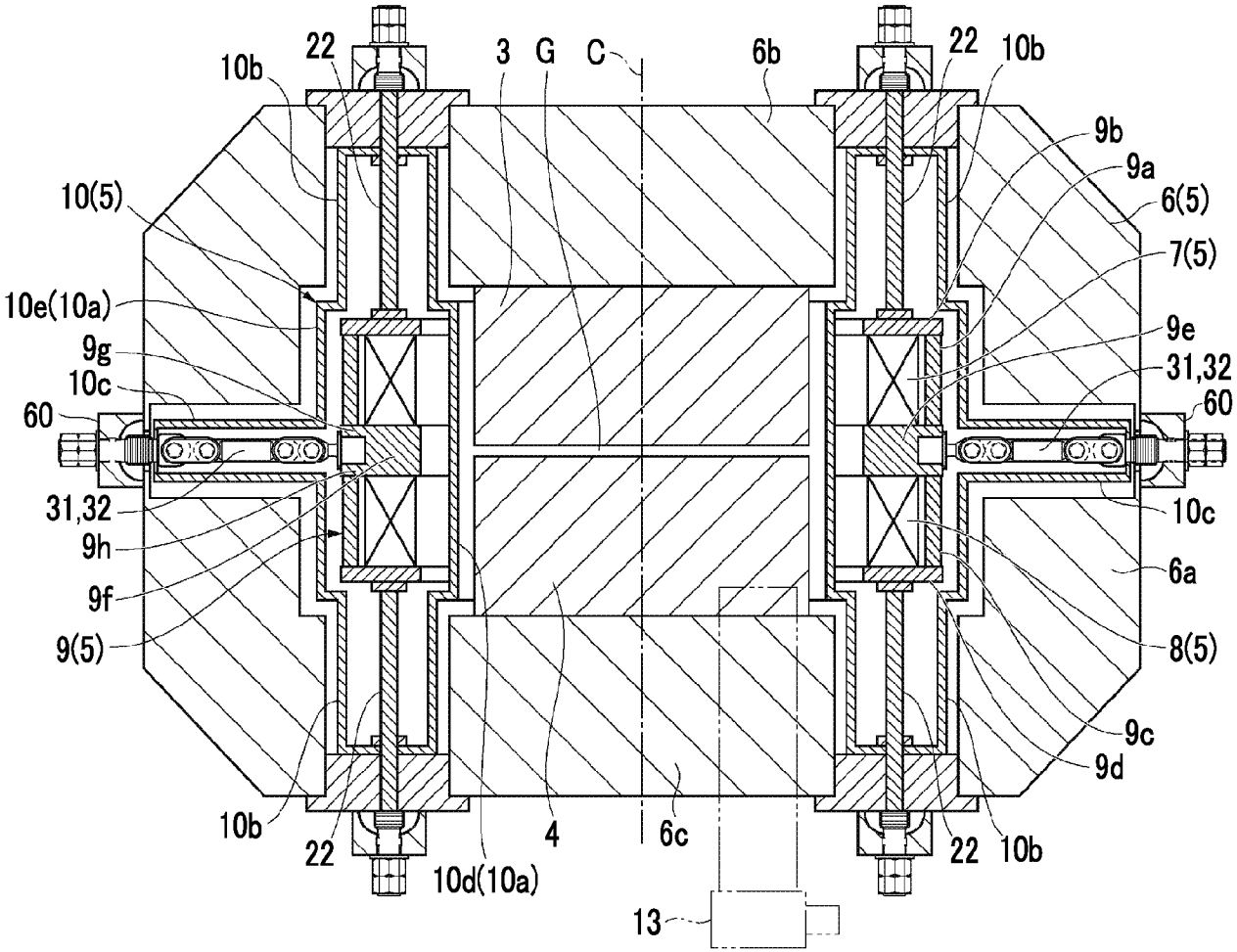
FIG. 1 is a sectional view illustrating a section obtained by cutting a cyclotron of an embodiment of the invention in a direction along a central axis of superconductive coils.

A preferred embodiment of the invention will be described below in detail, referring to the drawings. In addition, in the respective drawings, the same portions or equivalent portions are designated by the same reference signs, and the overlapping description thereof will be omitted.

As illustrated in FIG. 1, a cyclotron 1 related to the present embodiment is a horizontal circular accelerator that supplies charged particles into an acceleration space G from an ion source (not illustrated), and accelerates the charged particles within the acceleration space G to output a charged particle beam. Examples of the charged particles include, for example, protons, heavy particles (heavy ions), and the like. The cyclotron 1 is used as, for example, an accelerator for charged particle beam treatment.

In the cyclotron 1, in order to continuously accelerate the charged particle beam that draws a circular track within the acceleration space G, it is necessary to control flux density so as to guarantee isochronism (the time taken for one circling regardless of the size of the radius of a circular track is equal).

The cyclotron 1 includes a superconductive electromagnet apparatus 5 other than the ion source. The superconductive electromagnet apparatus 5 has poles 3 and 4, a yoke 6, superconductive coils 7 and 8, a coil supporting frame (coil support) 9, and a vacuum vessel 10.

The poles 3 and 4 are arranged so as to be spaced apart from each other in the direction of a central axis (the winding central axis of superconductive coils 7 and 8) C of the superconductive coils 7 and 8. In addition, in the cyclotron 1, the direction of the central axis C is arranged in an upward-downward direction. The pole 3 is an upper pole arranged above the acceleration space G, and the pole 4 is a lower pole arranged below the acceleration space G. Additionally, an electrode (a dee electrode, not illustrated) is provided between the poles 3 and 4. An electric field is formed by applying a high frequency to this electrode.

The yoke 6 is a hollow disk type block, and the poles 3 and 4 and the vacuum vessel 10 are arranged inside the yoke. The yoke 6 includes a cylindrical part 6*a*, a top part 6*b* formed so as to close one opening of the cylindrical part 6*a*, and a bottom part 6*c* formed so as to close the other opening of the cylindrical part 6*a*. The yoke 6 is to prevent lines of magnetic force generated in the superconductive coils 7 and 8 and the poles 3 and 4 from leaking to the outside.

Figure 2:
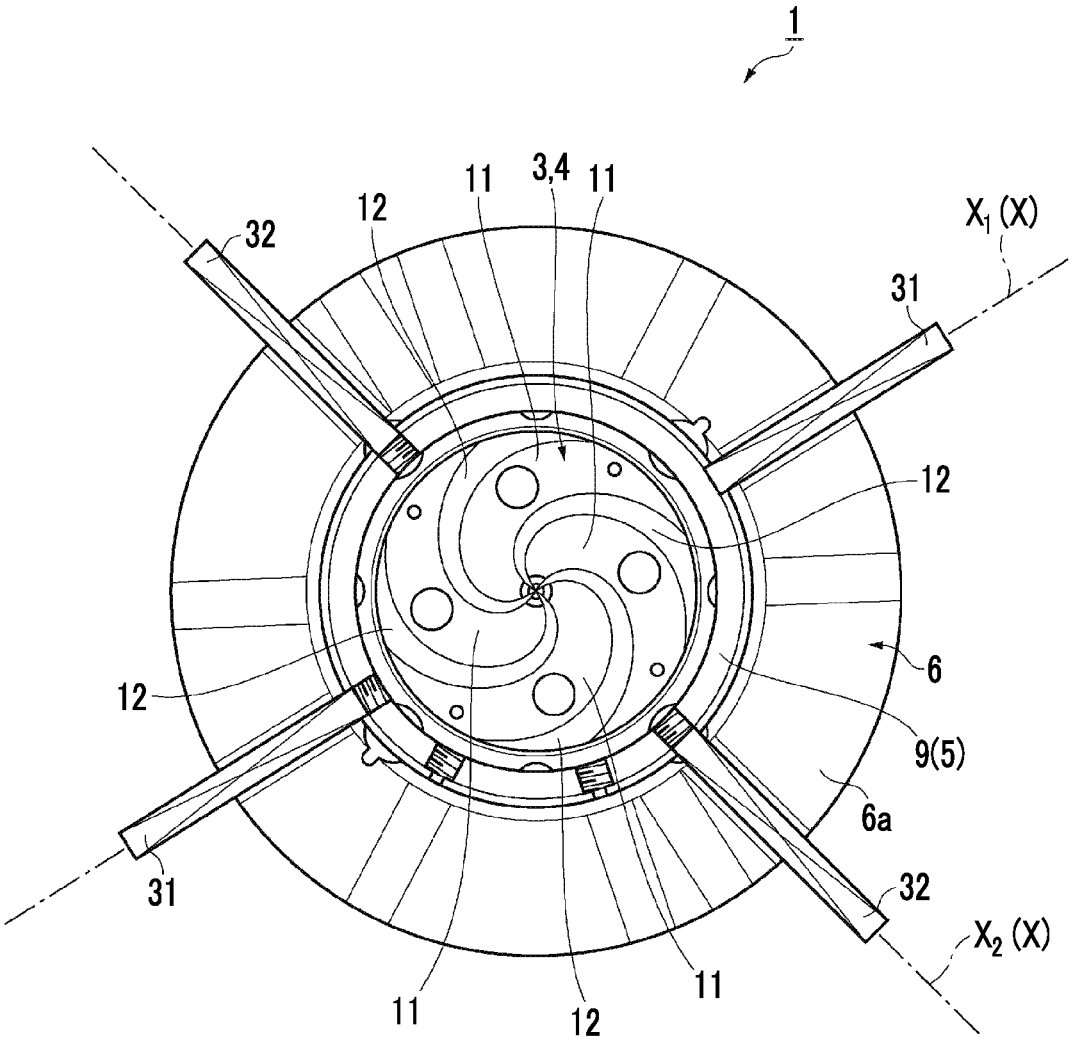
FIG. 2 is a sectional view illustrating a section obtained by cutting the cyclotron in a direction orthogonal to the central axis of the superconductive coils.

The poles 3 and 4, as illustrated in FIG. 2, have four hills 11 provided in a spiral shape that draws a spiral radially outward from the vicinity of the central axis C. The hills 11 face upward and downward with the acceleration space G interposed therebetween, and converge the charged particle beam within the acceleration space G in the upward-downward direction.

The hills 11 are arranged at equal intervals in a circumferential direction of the central axis C, and valleys 12 that are gaps are respectively formed between the hills 11 adjacent to each other in the circumferential direction. That is, the hills 11 and the valleys 12 are alternately formed in the circumferential direction in the poles 3 and 4. In the cyclotron 1, flux density is strengthened in the hills 11 and flux density is weakened in the valleys 12, whereby a charged particle beam is converged in a vertical direction (the direction of the central axis C) and a horizontal direction (the direction orthogonal to the central axis C). In this way, a cyclotron that forms flux density with strength and weakness in the circumferential direction is referred to as an azimuthally varying field [AVF] cyclotron.

In the AVF cyclotron, the four hills 11 are formed so that the flux density thereof becomes stronger as the hills become closer to a radial outer side. The hills 11 are formed in a spiral shape in order to strengthen the convergence force of a charged particle beam in the vertical direction. If the flux density becomes weaker as the hills become closer to the radial outer side, a divergence force perpendicular to the charged particle beam will work. In addition, the valleys 12 are not limited to the gaps, and may be metal with a thickness smaller than the thickness of the hills 11.

As illustrated in FIG. 1, the superconductive coils 7 and 8 are wound so as to cover outer peripheries of the poles 3 and 4. The superconductive coil 7 and the superconductive coil 8 are arranged side by side in the direction of the central axis C. The upper superconductive coil 7 is wound so as to cover the outer periphery of the pole 3, and the lower superconductive coil 8 is wound so as to cover the outer periphery of the pole 4. The superconductive coils 7 and 8 are, for example, air-core coils in which inner frames (or inner wiring frames) are not provided on inner peripheral sides thereof and inner peripheral surfaces of the coils (wire rods and adhesives that anchor the wire rods) are not bonded and fixed by other members.

The coil supporting frame 9 includes a side plate part 9*a* that covers an outer peripheral surface of the superconductive coil 7, an upper ring member 9*b* that covers an upper surface of the superconductive coil 7, a side plate part 9*c* that covers an outer peripheral surface of the superconductive coil 8, a lower ring member 9*d* that covers a lower surface of the superconductive coil 8, and an intermediate part 9*e* that couples the upper and lower side plate parts 9*a* and 9*c*. The coil supporting frame 9 is formed over the entire circumference in the circumferential direction of the superconductive coils 7 and 8.

The upper ring member 9*b* is formed so as to overhang radially inward from an upper end of the side plate part 9*a*. The upper ring member 9*b* constitutes an annular plate shape, and the thickness direction of the upper ring member 9*b* is arranged so as to run in the direction of the central axis C.

The lower ring member 9*d* is formed so as to overhang radially inward from a lower end of the side plate part 9*c*. The lower ring member 9*d* constitute an annular plate shape, and the thickness direction of the lower ring member 9*d* is arranged so as to run in the direction of the central axis C.

The intermediate part 9*e* has an intermediate ring part 9*f*, an upper overhanging part 9*g*, and a lower overhanging part 9*h*. The width of the intermediate ring part 9*f* in a radial direction corresponds to the width of the superconductive coils 7 and 8 in the radial direction. The section of the intermediate ring part 9*f* forms, for example, a rectangular shape. An upper surface of the intermediate ring part 9*f* abuts against the lower surface of the superconductive coil 7, and a lower surface of the intermediate ring part 9*f* abuts against the upper surface of the superconductive coil 8. The upper overhanging part 9*g* and the lower overhanging part 9*h* overhang radially outward from an outer peripheral surface of the intermediate ring part 9*f*. The upper overhanging part 9*g* and the lower overhanging part 9*h* are arranged so as to be spaced apart from each other in the direction of the central axis C. The upper overhanging part 9*g* is joined to the side plate part 9*a*, and the lower overhanging part 9*h* is joined to the side plate part 9*c*. Specifically, an upper surface of the upper overhanging part 9*g* abuts against a lower surface of the side plate part 9*a*, and a lower surface of the lower overhanging part 9*h* abuts against an upper surface of the side plate part 9*c*. The joining between the upper overhanging part 9*g* and the side plate part 9*a* may be performed by bolt joining or may be performed by other joining methods, such as welding. Similarly, the joining between the lower overhanging part 9*h* and the side plate part 9*c* may be performed by bolt joining or may be performed by other joining methods, such as welding.

The vacuum vessel 10 houses the superconductive coils 7 and 8 and the coil supporting frame 9. The vacuum vessel has a coil housing part 10*a* that houses the superconductive coils and the coil supporting frame 9, a communication part 10*b* that communicates with the coil housing part 10*a* and extends in the upward-downward direction, and a communication part 10*c* that extends in the horizontal direction. The coil housing part 10*a* has an inner wall 10*d* that is arranged on radial inner sides of the superconductive coils 7 and 8, and an outer wall 10*e* that is arranged on radial outer sides of the superconductive coils 7 and 8. The inner wall 10*d* is arranged so as to cover the inner peripheral sides of the superconductive coils 7 and 8 and the coil supporting frame 9, and the outer wall 10*e* is arranged so as to cover outer peripheral sides of the superconductive coils 7 and 8 and the coil supporting frame 9. That is, the superconductive coils 7 and 8 and the coil supporting frame 9 are arranged within a housing space sandwiched between the inner wall 10*d* and the outer wall 10*e*.

Additionally, the vacuum vessel 10 has an upper surface wall that closes an upper side of the housing space, and a lower surface wall that closes a lower side of the housing space. The upper surface wall is arranged to face the upper ring member 9*b* in the direction of the central axis C, and the lower surface wall is arranged to face the lower ring member 9*d* in the direction of the central axis C. An opening is provided in the upper surface wall, and the communication part 10*b* is arranged to correspond to this opening. Similarly, an opening is provided in the lower surface wall, and the communication part 10*b* is arranged to correspond to this opening.

The communication part 10*b* forms, for example, a cylindrical shape, and extends in the direction of the central axis C. The communication part 10*b* houses vertical load supports 21 and 22 to be described below. The communication part 10*c* forms, for example, a cylindrical shape, and extends in an orthogonal direction orthogonal to the central axis C. The communication part 10*c* houses horizontal load supports 31 and 32 to be described below. Additionally, a refrigerator (cooling part) 13 for cooling the superconductive coils 7 and 8 is connected to the vacuum vessel 10. The refrigerator 13 is, for example, a GM refrigerator, and can cool the superconductive coils 7 and 8 to 4 K. The refrigerator is not limited to the GM refrigerator (Gifford-McMahon cooler), and may be, for example, other refrigerators including a sterling refrigerator.

Here, the cyclotron 1 has the vertical load supports (first supports) 21 and 22 that support the coil supporting frame 9 and adjust the position of the coil supporting frame 9 in the direction of the central axis C, and the horizontal load supports (second supports) 31 and 32 that support the coil supporting frame 9 and adjust the position of the coil supporting frame 9 in the radial direction. In addition, the radial direction is the orthogonal direction orthogonal to the central axis C.

The vertical load supports 21 and 22 are relatively fixed with respect to the yoke 6, and support the coil supporting frame 9 from the direction of the central axis C. The vertical load supports 21 and 22 are arranged as a pair of upper and lower load supports so as to sandwich the coil supporting frame 9 therebetween, and support the coil supporting frame 9 by pulling the coil supporting frame 9 in directions opposite to each other. A plurality of the vertical load supports 21 and 22 are arranged in the circumferential direction of the coil supporting frame 9. The plurality of vertical load supports 21 and 22 are arranged at equal intervals in the circumferential direction of the coil supporting frame 9.

A lower end of the vertical load support 21 is coupled to the upper ring member 9*b*. The vertical load support 21 extends upward from the upper ring member 9*b*, passes through a wall of the vacuum vessel 10, and overhangs to the outside of the yoke 6. A positioning part that positions the vertical load support 21 with respect to the yoke 6 is provided at an upper end of the vertical load support 21. The vertical load support 21 can be displaced in the direction of the central axis C by this positioning part. Positional adjustment using a screw is mentioned as the positioning part. By rotating a nut attached to the screw, the screw is moved in the direction of the central axis C, and the vertical load support 21 is displaced. An attachment part and the positioning part of the vertical load support 21 to the yoke 6 can have the same configuration as the horizontal load support 31 to be described below.

The upper end of the vertical load support 22 is coupled to the lower ring member 9*d*. The vertical load support 22 extends downward from the lower ring member 9*d*, passes through a wall of the vacuum vessel 10, and overhangs to the outside of the yoke 6. A positioning part that positions the vertical load support 22 with respect to the yoke 6 is provided at a lower end of the vertical load support 22. The vertical load support 22 can be displaced in the direction of the central axis C by this positioning part. Positional adjustment using a screw is mentioned as the positioning part. By rotating a nut attached to the screw, the screw is moved in the direction of the central axis C, and the vertical load support 22 is displaced. An attachment part and the positioning part of the vertical load support 22 to the yoke 6 can have the same configuration as the horizontal load support 31 to be described below.

The positions of the superconductive coils 7 and 8 with respect to the poles 3 and 4 can be appropriately changed by performing positional adjustment using the plurality of vertical load supports 21 and 22. Specifically, the superconductive coils 7 and 8 are displaced so that the superconductive coils 7 and 8 can be displaced upward, the superconductive coils 7 and 8 are displaced downward, or the central axis C of the superconductive coils 7 and 8 is inclined with respect to the vertical direction.

The horizontal load supports 31 and 32 are relatively fixed with respect the yoke 6, and support the coil supporting frame 9 from the radial outer side. A plurality of (for example, 4) the horizontal load supports 31 and 32 are provided. Here, the upward-downward direction is defined as a Z-axis, and axes orthogonal to the Z-axis and orthogonal to each other are defined as an X-axis (first direction) and a Y-axis (second direction) (refer to FIGS. 3 to 5). In a case where the central axis C of the superconductive coils 7 and 8 is arranged along the Z-axis, the X-axis and the Y-axis are orthogonal to the central axis C. As illustrated in FIG. 1, a pair of horizontal load supports 31 is arranged to face each other with the coil supporting frame 9 interposed therebetween, and a pair of horizontal load supports 32 is arranged to face each other with the coil supporting frame 9 interposed therebetween. In addition, a direction $X_1$ (X-axis direction) in which the pair of horizontal load supports 31 extends, and a direction $X_2$ (X-axis direction) in which the pair of horizontal load supports 32 extends may be orthogonal to each other, or may intersect each other at a predetermined angle.

The pair of horizontal load supports 31 supports the coil supporting frame 9 by pulling the coil supporting frame 9 in the directions opposite to each other. Similarly, the pair of horizontal load supports 32 supports the coil supporting frame 9 by pulling the coil supporting frame 9 in the directions opposite to each other.

Figure 3:
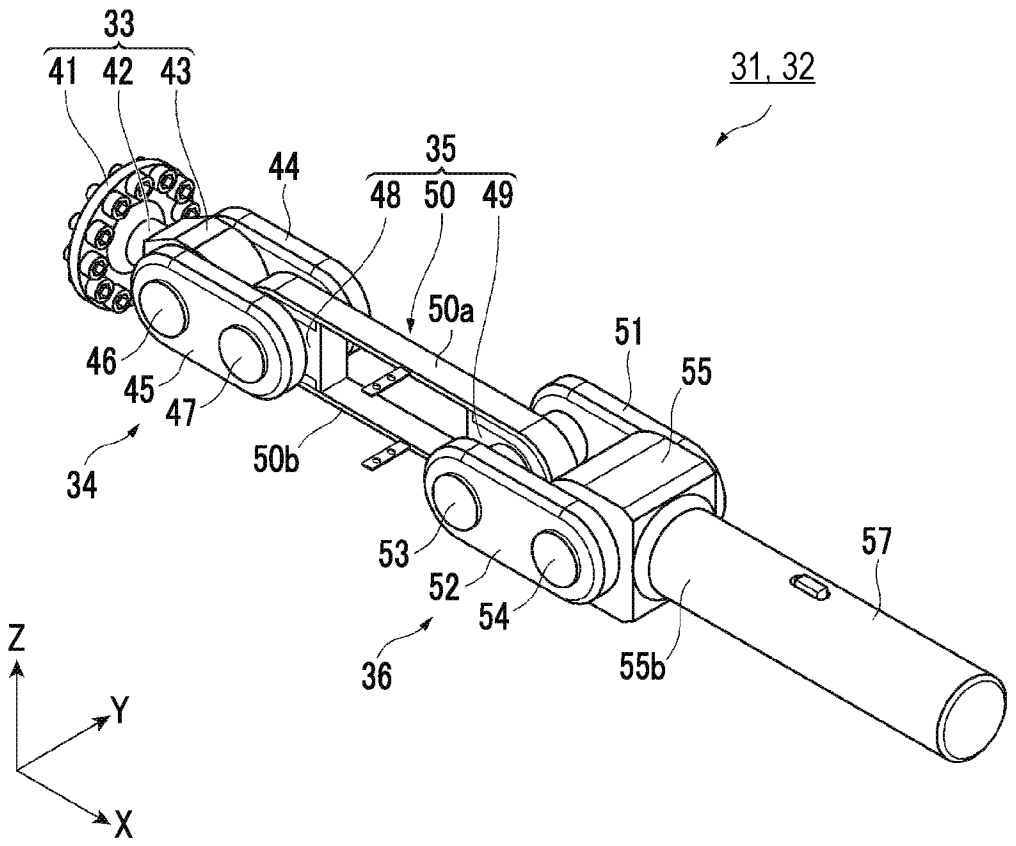
FIG. 3 is a perspective view illustrating a horizontal load support.
Figure 4:
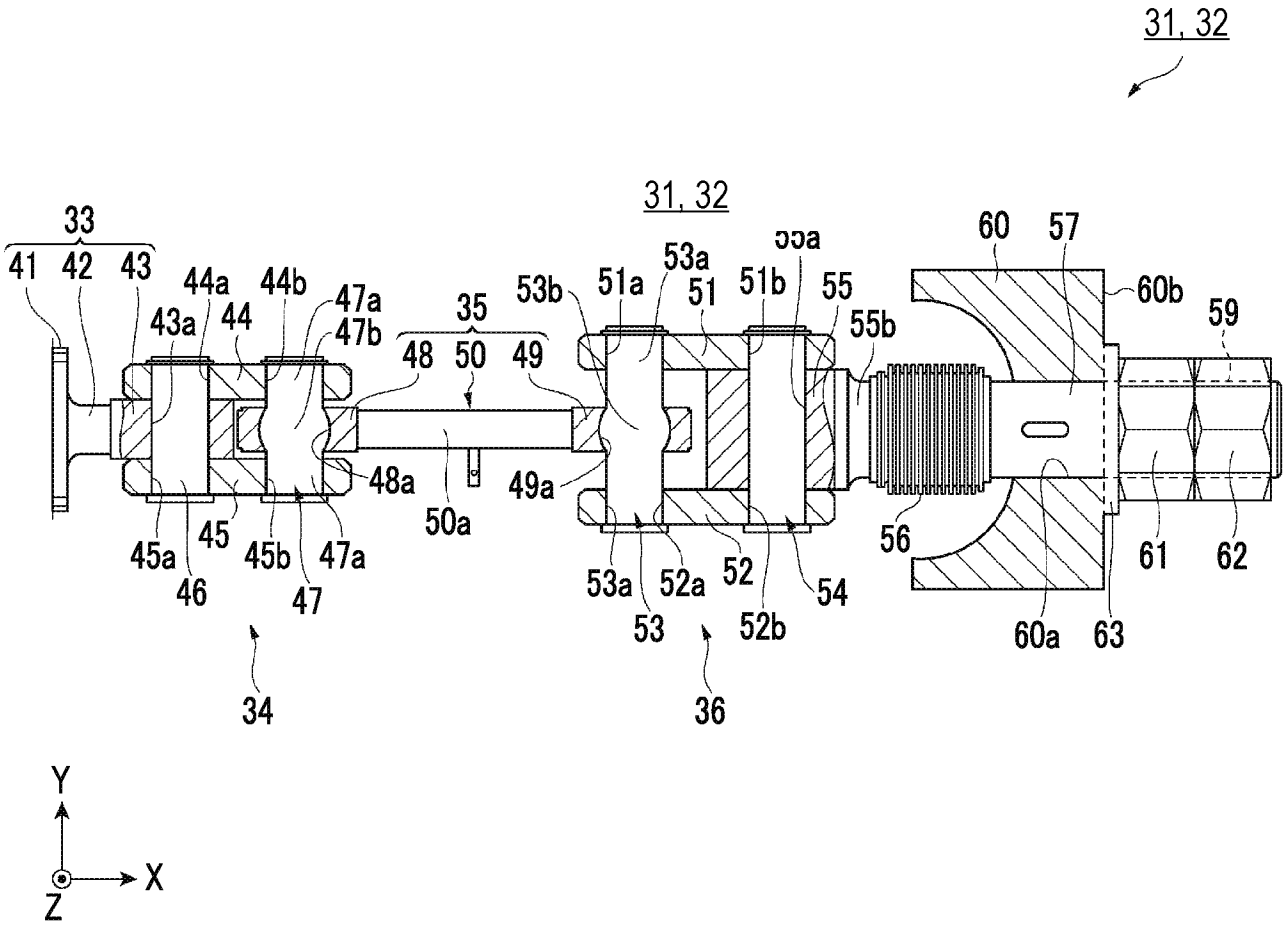
FIG. 4 is a sectional view illustrating the horizontal load support.
Figure 5:
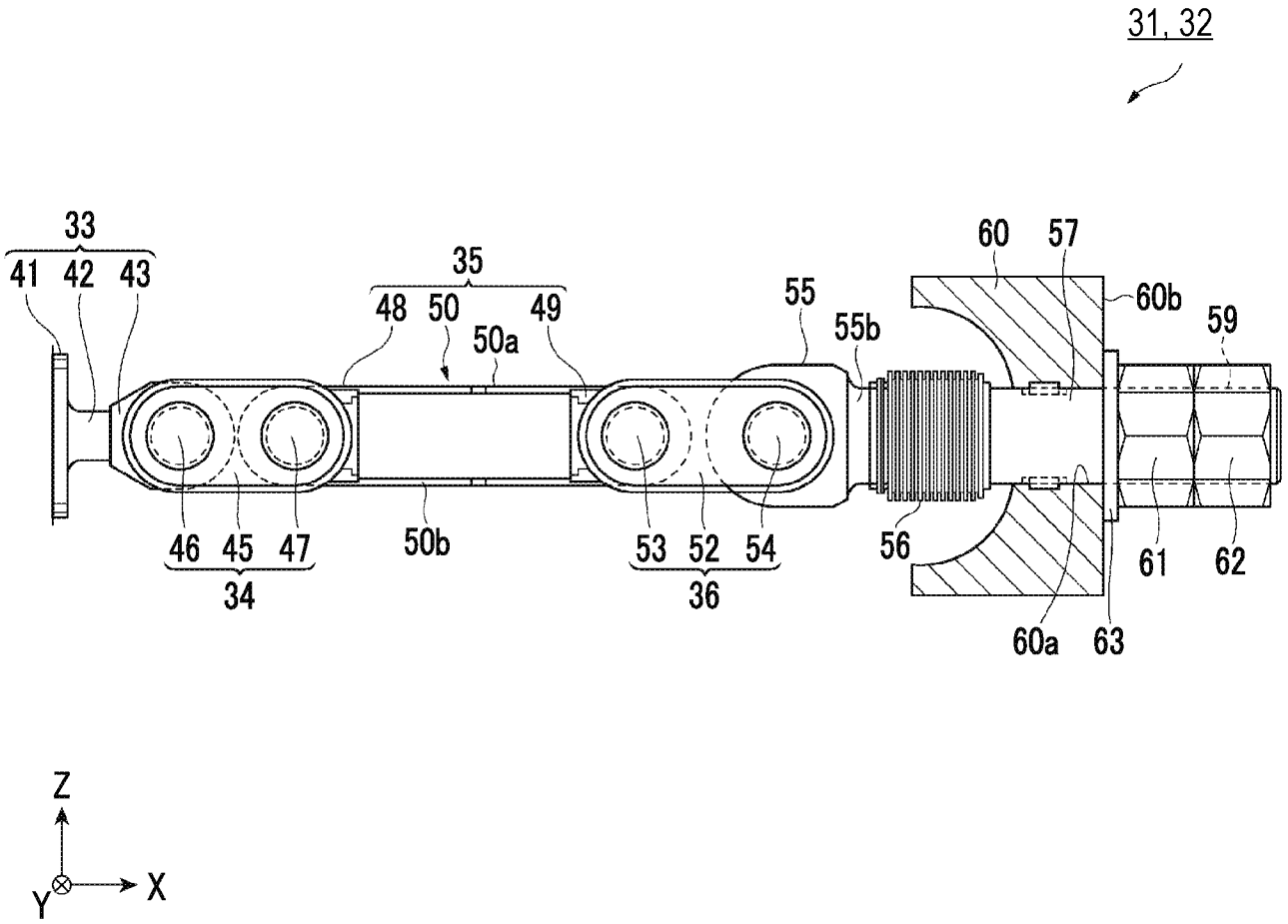
FIG. 5 is a side view illustrating the horizontal load support.

FIG. 3 is a perspective view illustrating the horizontal load supports 31 and 32. FIG. 4 is a sectional view illustrating the horizontal load supports 31 and 32. FIG. 5 is a side view illustrating the horizontal load supports 31 and 32. As illustrated in FIGS. 3 to 5, the horizontal load supports 31 and 32 have a coil supporting frame attachment part 33, an inner link part 34, an intermediate coupling part 35, an outer link part 36, and a yoke attachment part 37. Hereinafter, the horizontal load support 31 will be described. Since the horizontal load support 32 is different from the horizontal load support 31 only in an arrangement direction and has the same configuration as the horizontal load support 31, the description of the horizontal load support 32 will be omitted.

The coil supporting frame attachment part 33 is a portion to be attached to the coil supporting frame 9. The coil supporting frame attachment part 33 has a flange part 41 that is fixed to the coil supporting frame 9, and an extending part 42 that extends from the flange part 41. The flange part 41 forms a disk shape, and has one surface connected to the coil supporting frame 9. The flange part 41 is connected to the intermediate part 9*e* of the coil supporting frame 9 by bolt joining. In addition, the flange part 41 may have a configuration in which the flange part is connected to parts other than the intermediate part 9*e* of the coil supporting frame 9. The coil supporting frame attachment part 33 and the inner link part 34 are formed of, for example, titanium. The coil supporting frame attachment part 33 and the inner link part 34 may be formed of, for example, materials such as stainless steel, other than titanium.

The extending part 42 extends outward (the radial outer sides of the superconductive coils 7 and 8) in the X-axis direction from the other surface of the flange part 41. A coupling block part 43 is provided at an outer end of the extending part 42 in the X-axis direction. A through-hole 43*a* penetrating in a Y-axis direction is formed in the coupling block part 43. Additionally, side surfaces of the coupling block part 43 that face the Y-axis direction are flat surfaces.

The inner link part 34 has a pair of coupling plates (first direction members) 44 and 45 that are arranged so as to be spaced apart from each other in the Y-axis direction, a pin member 46 that couples one ends of the pair of coupling plates 44 and 45 and a spherical shaft 47 that couples the other ends of the pair of coupling plates 44 and 45.

The coupling plates 44 and 45 have a predetermined length in the X-axis direction. The thickness direction of the coupling plates 44 and 45 is arranged so as to run in the Y-axis direction. Through-holes 44*a*, 44*b*, 45*a*, and 45*b* penetrating in the thickness direction are provided at both ends of the coupling plates 44 and 45 in the X-axis direction, respectively. Additionally, the pair of coupling plates 44 and 45 is arranged so as to sandwich the coupling block part 43 therebetween in the Y-axis direction. Inner surfaces (surfaces that face side surfaces of the coupling block part 43) of the coupling plates 44 and 45 are formed as flat surfaces. The inner surfaces of the coupling plates 44 and 45 abut against the side surfaces of the coupling block part 43.

The pin member 46 forms a columnar shape, and is inserted through the through-hole 43*a* of the coupling block part 43. An outer peripheral surface of the pin member 46 abuts against an inner peripheral surface of the through-hole 43*a*. The pin member 46 is supported so as to be rotatable around the axis of the pin member 46 with respect to the coupling block part 43. Additionally, both ends of the pin member 46 overhang outward from the side surfaces of the coupling block part 43 in the Y-axis direction.

Both the ends of the pin member 46 in the Y-axis direction are respectively inserted through the through-holes 44*a* and 45*a* on one end sides of the pair of coupling plates 44 and 45. At both the ends of the pin member 46, the outer peripheral surface of the pin member 46 abuts against the inner peripheral surfaces of the through-holes 44*a* and 45*a* on one end sides of the pair of coupling plates 44 and 45. The pin member 46 is supported so as to be rotatable around the axis of the pin member 46 with respect to the pair of coupling plates 44 and 45. Accordingly, the pair of coupling plates 44 and 45 is supported so as to be rotatable around the Y-axis with respect to the coil supporting frame attachment part 33.

The spherical shaft 47 has columnar parts 47*a* that are provided at both ends in the Y-axis direction, and a sphere part 47*b* that is arranged between the columnar parts 47*a*. The columnar parts 47*a* are respectively inserted through the through-holes 44*b* and 45*b* on the other end sides of the pair of coupling plates 44 and 45. Outer peripheral surfaces of the columnar parts 47*a* abut against the inner peripheral surfaces of the through-holes 44*b* and 45*b* on the other end sides of the pair of coupling plates 44 and 45.

The sphere part 47*b* has a greater external diameter than the external diameter of the columnar parts 47*a*. Additionally, the width of the sphere part 47*b* in the Y-axis direction is smaller than the external diameter of the sphere part 47*b*, for example, is smaller than the width (thickness) of the coupling block part 43 in the Y-axis direction. Additionally, the center of the sphere part 47*b* is arranged at the center between the pair of coupling plates 44 and 45.

The intermediate coupling part 35 is apart that couples the inner link part 34 and the outer link part 36. The intermediate coupling part 35 has a bearing part (spherical bearing part) 48 that is provided on one end side and holds the spherical shaft 47 of the inner link part 34, a bearing part (spherical bearing part) 49 that is provided on the other end side and holds a spherical shaft 53 of the outer link part 36, and a strap part 50 that couples both of the bearing parts 48 and 49.

The bearing part 48 has a block body, and a sphere receiving part that receives the sphere part 47*b* of the spherical shaft 47 is formed in this block body. The sphere receiving part is an opening that holds the sphere part 47*b*. An inner surface shape of the sphere receiving part corresponds to an outer surface shape of the sphere part 47*b*, and an inner surface 48*a* of the sphere receiving part is an abutting surface that abuts against an outer surface of the sphere part 47*b*. Additionally, the side surfaces of the bearing part 48 that face the Y-axis direction are arranged to face the inner surfaces of the pair of coupling plates 44 and 45 in the Y-axis direction. A predetermined gap is formed between the side surfaces of the bearing part 48 and the inner surfaces of the pair of coupling plates 44 and 45. The bearing part 48 is slidable along the outer surface (spherical surface) of the sphere part 47*b* of the spherical shaft 47.

In addition, a configuration in which a pin member and a spherical sliding bearing are included instead of the spherical shaft 47 and the bearing part 48 may be adopted. In this configuration, the pin member held by the spherical sliding bearing is inserted through and held by the through-holes 44*b* and 45*b* on the other end sides of the pair of coupling plates 44 and 45.

The bearing part 49 has a block body, and a sphere receiving part that receives a sphere part 53*b* of the spherical shaft 53 (to be described below) of the outer link part 36 is formed in this block body. The sphere receiving part is an opening that holds the sphere part 53*b*. An inner surface shape of the sphere receiving part corresponds to an outer surface shape of the sphere part 53*b*, and an inner surface 49*a* of the sphere receiving part is an abutting surface that abuts against an outer surface of the sphere part 53*b*. Additionally, the side surfaces of the bearing part 49 that face the Y-axis direction are arranged to face the inner surfaces of a pair of coupling plates 51 and 52 in the Y-axis direction. A predetermined gap is formed between the side surfaces of the bearing part 49 and the inner surfaces of the pair of coupling plates 51 and 52. The bearing part 49 is slidable along the outer surface (spherical surface) of the sphere part 53*b* of the spherical shaft 53.

In addition, a configuration in which a pin member and a spherical sliding bearing are included instead of the spherical shaft 53 and the bearing part 49 may be adopted. In this configuration, the pin member held by the spherical sliding bearing is inserted through and held by through-holes 51*a* and 52*a* on the other end sides of the pair of coupling plates 51 and 52 (to be described below) of the outer link part 36.

The strap part 50, as illustrated in FIG. 5, has a pair of beltlike parts 50*a* and 50*b* that are spaced apart from each other in the upward-downward direction and extend in a X-axis direction. The thickness direction of the beltlike parts 50*a* and 50*b* is arranged in the Z-axis direction. Additionally, the width direction of the beltlike parts 50*a* and 50*b* corresponds to, for example, the width of the bearing parts 48 and 49 in the Y-axis direction. The strap part 50 is formed of, for example, carbon fiber reinforced plastic (CFRP).

One end sides of the beltlike parts 50*a* and 50*b* are coupled to the bearing part 48, and the other ends of the beltlike parts 50*a* and 50*b* are coupled to the bearing part 49. The beltlike parts 50*a* and 50*b* may be fixed to the block bodies of the bearing parts 48 and 49 by fasteners for fixing the beltlike parts, for example, may be joined by bonding or may be integrally molded with portions of the block bodies. Additionally, the strap part 50 may be formed in an endless fashion by the ends of the pair of beltlike parts 50*a* and 50*b* being connected together.

The strap part 50 is supported so as to be rockable (rotatable) around the Y-axis with respect to the inner link part 34. Additionally, the strap part 50 is supported so as to be tiltable (rotatable) around the X-axis with respect to the inner link part 34. The strap part 50 is supported so as to be rockable (rotatable) around the Z-axis with respect to the inner link part 34.

Similarly, the strap part 50 is supported so as to be rockable (rotatable) around the Y-axis with respect to the outer link part 36. Additionally, the strap part 50 is supported so as to be tiltable (rotatable) around the X-axis with respect to the outer link part 36. The strap part 50 is supported so as to be rockable (rotatable) around the Z-axis with respect to the outer link part 36.

Additionally, the intermediate coupling part 35 may include a plate-like member having a predetermined length instead of the strap part 50, or may include a rod-shaped member having a predetermined length. Additionally, the intermediate coupling part 35 may be configured to include a plurality of strap parts connected together via a link mechanism.

The outer link part 36 has the pair of coupling plates (first direction members) 51 and 52 that are arranged so as to be spaced apart from each other in the Y-axis direction, the spherical shaft 53 that couples the one ends of the pair of coupling plates 51 and 52, and a pin member 54 that couples the other ends of the pair of coupling plates 51 and 52.

The coupling plates 51 and 52 have a predetermined length in the X-axis direction. The thickness direction of the coupling plates 51 and 52 is arranged so as to run in the Y-axis direction. Through-holes 51*a*, 51*b*, 52*a*, and 52*b* penetrating in the thickness direction are provided at both ends of the coupling plates 51 and 52 in the X-axis direction, respectively. Additionally, the pair of coupling plates 51 and 52 is arranged so as to sandwich the coupling block part 55 (to be described below) of the yoke attachment part 37 therebetween in the Y-axis direction. Inner surfaces (surfaces that face side surfaces of the coupling block part 55) of the coupling plates 51 and 52 are formed as flat surfaces. The inner surfaces of the coupling plates 51 and 52 abut against the side surfaces of the coupling block part 55.

The spherical shaft 53 has columnar parts 53*a* that are provided at both ends in the axis direction, and a sphere part 53*b* that is arranged between the columnar parts 53*a*. The columnar parts 53*a* are respectively inserted through the through-holes 51*a* and 52*a* on one end sides of the pair of coupling plates 51 and 52. Outer peripheral surfaces of the columnar parts 53*a* abut against the inner peripheral surfaces of the through-holes 51*a* and 52*a* on one end sides of the pair of coupling plates 51 and 52.

The sphere part 53*b* has a larger external diameter than the external diameter of the columnar parts 53*a*. Additionally, the width of the sphere part in the Y-axis direction is smaller than the external diameter of the sphere part 53*b*, for example, is smaller than the width (thickness) of the coupling block part 55 in the Y-axis direction. Additionally, the center of the sphere part 53*b* is arranged at the center between the pair of coupling plates 51 and 52.

The pin member 54 forms a columnar shape, and is inserted through a through-hole 55*a* of the coupling block part 55 of the yoke attachment part 37. An outer peripheral surface of the pin member 54 abuts against an inner peripheral surface of the through-hole 55*a* of the coupling block part 55. The pin member 54 is supported so as to be rotatable around the axis of the pin member 54 with respect to the coupling block part 55. Additionally, both ends of the pin member 54 overhang outward from the side surfaces of the coupling block part 55 in the Y-axis direction.

Both ends of the pin member 54 in the longitudinal direction are respectively inserted through the through-holes 51*b* and 52*b* on the other end sides of the pair of coupling plates 51 and 52. At both the ends of the pin member 54, the outer peripheral surface of the pin member 54 abuts against the inner peripheral surfaces of the through-holes 51*b* and 52*b* on the other end sides of the pair of coupling plates 51 and 52. The pin member 54 is supported so as to be rotatable around the axis of the pin member 54 with respect to the pair of coupling plates 51 and 52. Accordingly, the pair of coupling plates 51 and 52 is supported so as to be rotatable around the Y-axis with respect to the yoke attachment part 37.

The yoke attachment part 37 is a part to be attached to the yoke 6. The yoke attachment part 37 has the coupling block part 55, a bellows 56, a rod part 57, and a position adjusting part 58.

The through-hole 55*a* through which the pin member 54 is inserted is formed in the coupling block part 55. The through-hole 55*a* penetrates in the Y-axis direction. Additionally, side surfaces of the coupling block part 55 that face the Y-axis direction are flat surfaces. The coupling block part 55 is arranged so as to be sandwiched between the pair of coupling plates 51 and 52, and the pin member 54 inserted through the through-hole 55*a* is inserted through the through-holes 51*b* and 52*b* of the pair of coupling plates 51 and 52. Additionally, the side surfaces of the coupling block part 55 abut against the inner surfaces of the pair of coupling plates 51 and 52.

The coupling block part 55 is provided with an overhanging part 55*b* that overhangs outward from an outer end surface in the X-axis direction. The bellows 56 is connected to the overhanging part 55*b*. In addition, illustration of the bellows 56 and a thread part 59 to be described below is omitted in FIG. 3. The bellows 56 is a joint that has a bellows shape and is expansible in the X-axis direction. The bellows 56 is formed of, for example, stainless steel (SUS304). One end side of the bellows 56 is connected to the overhanging part 55*b*, and the other end side of the bellows 56 is connected to the rod part 57. The bellows 56 and the overhanging part 55*b* are joined together by, for example, welding. Similarly, the bellows 56 and the rod part 57 are joined together by, for example, welding.

The rod part 57 is a rod-shaped member that extends outward from the bellows 56. The rod part 57 is formed of, for example, stainless steel (SUS304). The rod part 57 passes through the yoke 6 and protrudes further outward than a side surface of the yoke 6. The thread part 59 is formed on an outer peripheral surface of an outer end of the rod part 57.

The position adjusting part 58 is a positioning part that is fixed to the yoke 6 and performs positioning with respect to the yoke 6. The position adjusting part 58 has a load support fixing part 60 that protrudes outward from an outer peripheral surface of the yoke 6, the thread part 59 that is formed on the outer peripheral surface of the outer end of the rod part 57, and nuts 61 and 62 that are attached to the thread part 59.

The load support fixing part 60 is a block body that is fixed to the yoke 6. The load support fixing part 60 is joined to the yoke 6, for example, by welding or the like. A through-hole 60*a* through which the rod part 57 is inserted is formed in the load support fixing part 60. The rod part 57 is inserted through the through-hole 60*a*, and extends up to the outside of the yoke 6. Additionally, a seat surface 60*b* that is a surface orthogonal to the X-axis of the load support fixing part 60 is a flat surface. Additionally, a key groove is formed in an inner peripheral surface of the through-hole 60*a*, and the rotation of the rod part 57 around the axis is prevented.

The thread part 59 is formed on the outer peripheral surface of the outer end of the rod part 57. The thread part 59 is formed from a portion where the rod part 57 is arranged in the through-hole 60*a* to a portion arranged outside the through-hole 60*a*. A washer 63 and the nuts 61 and 62 are attached to the thread part 59 of the rod part 57. The washer 63 is arranged between the seat surface 60*b* of the load support fixing part 60, and the nut 61. By tightening the nut 61, the washer 63 is pressed against the seat surface 60*b* of the load support fixing part 60.

By tightening the nut 61, the rod part 57 can be moved to the outside (illustrated right side) in the X-axis direction, and a tensile force can be exerted on the horizontal load support 31. As the tensile force is generated in the horizontal load support 31, the nut 61 and the washer 63 are pressed against the seat surface 60*b* of the load support fixing part 60. Accordingly, the rod part 57 is fixed to the load support fixing part 60 via the nut 61 and the washer 63. That is, the yoke attachment part 37 of the horizontal load support 31 is fixed to the yoke 6 and is fixed relative to the poles 3 and 4.

Next, the operation of the cyclotron 1 will be described.

In the cyclotron 1, the superconductive coils 7 and 8 of the superconductive electromagnet apparatus 5 are energized, and magnetic flux is generated around the superconductive coils 7 and 8. This magnetic flux forms a magnetic circuit around the superconductive coils 7 and 8 through the yoke 6 and the poles 3 and 4, and a magnetic field is formed in the acceleration space G between the pair of poles 3 and 4 that faces each other. The charged particles supplied to the acceleration space G are accelerated by a magnetic field and an electric field, and is emitted as a charged particle beam.

In the cyclotron 1, the position of the coil supporting frame 9 in the upward-downward direction can be adjusted using the vertical load supports 21 and 22. Additionally, positional adjustment can be performed by the positional adjustment using the plurality of vertical load supports 21 and 22 so that the inclination of the coil supporting frame 9 is changed. Accordingly, the positions and inclination of the superconductive coils 7 and 8 can be adjusted, and the charged particle beam can be adjusted by adjusting the magnetic field in the acceleration space G.

In the cyclotron 1, since the coil supporting frame 9 is supported by the horizontal load supports 31 and 32, the coil supporting frame 9 can be moved and positionally adjusted in the direction orthogonal to the direction of the central axis C, using the horizontal load supports 31 and 32.

Additionally, since the horizontal load supports 31 and 32 include the inner link part 34, the intermediate coupling part 35, and the outer link part 36, the flange part 41 of the horizontal load support 31 is displaceable in the direction of the central axis C and in the direction orthogonal to the central axis C, with respect to the load support fixing part 60. Therefore, the coil supporting frame 9 can be supported by following the positional adjustment using the vertical load supports 21 and 22.

For example, in a case where the coil supporting frame 9 is displaced so as to be inclined, the inner link part 34 and the intermediate coupling part 35 are appropriately rocked and displaced around the X-axis. Additionally, in a case where the coil supporting frame 9 is displaced upward or downward, the outer link part 36, the intermediate coupling part 35, and the inner link part 34 are appropriately rocked and rotationally moved around the Y-axis with respect to the yoke attachment part 37. Additionally, in a case where the coil supporting frame 9 is inclined and is displaced in the upward-downward direction, the inner link part 34 and the intermediate coupling part 35 are appropriately rotationally moved around the X-axis, and the outer link part 36, the intermediate coupling part 35, and the inner link part 34 are appropriately rocked and displaced with respect to the yoke attachment part 37. Additionally, in a case where the coil supporting frame 9 is displaced in the Y-axis direction, the inner link part 34 and the intermediate coupling part 35 are appropriately rocked and displaced around the Z-axis. That is, according to the horizontal load supports 31 and 32, the horizontal load supports are rockable around any axis of the X-axis, the Y-axis, and the Z-axis, and the flange part 41 can be displaced in any direction with respect to the yoke attachment part 37. Therefore, the positional adjustment of the superconductive coils 7 and 8 by the vertical load supports 21 and 22 is not hindered. As a result, the superconductive coils 7 and 8 can be positionally adjusted with high precision, and a beam output from the cyclotron 1 can be precisely adjusted.

Additionally, in the horizontal load supports 31 and 32, the position adjusting part 58 is included. Thus, the rod part 57 can be moved in the X-axis direction with respect to the load support fixing part 60 by rotationally operating the nut 61. By appropriately moving the positions of the plurality of horizontal load supports 31 and 32, the coil supporting frame 9 can be move in the direction orthogonal to the central axis C and can be positionally adjusted. Accordingly, a charged particle beam can be adjusted by moving the superconductive coils 7 and 8 in the direction orthogonal to the central axis C to adjust the magnetic field generated by the superconductive coils 7 and 8.

Additionally, since the position adjusting part 58 can displace the rod part 57 by rotating the nut 61, the amount of displacement of the rod part 57 with respect to one rotation of the nut 61 can be made constant. Therefore, the management of the positional adjustment can be facilitated.

Additionally, since the horizontal load supports 31 and 32 include the inner link part 34 and the outer link part 36 and are rockable around the Y-axis, in a case where the horizontal load supports 31 and 32 are thermally contracted due to a temperature change and the total length thereof varies, the inner link part 34, the intermediate coupling part 35, and the outer link part 36 can be appropriately rocked and displaced, and the variation caused by the thermal contraction can be absorbed.

Additionally, since the horizontal load supports 31 and 32 are formed of materials, such as stainless steel and titanium, and have a predetermined strength at its service temperatures, the load acting on the coil supporting frame 9 in response to the electromagnetic force generated by the superconductive coils 7 and 8 can be received.

The invention is not limited to the aforementioned embodiment, and various alternations as follows can be made without departing from the concept of the invention.

The superconductive coils 7 and 8 of the superconductive electromagnet apparatus 5 are not limited to a case where two superconductive coils 7 and 8 are included, and one or three or more superconductive coils may be included.

Additionally, the superconductive electromagnet related to the invention is not limited to the cyclotron, and can also be applied to a silicon single crystal lifting device using the MCZ method. If the superconductive electromagnet is a device in which a high magnetic field is obtained, the superconductive electromagnet is applicable to any devices.

Additionally, in the above embodiment, a configuration in which four horizontal load supports 31 and 32 are included is adopted. However, a configuration including one horizontal load support may be adopted, or a configuration including two or more horizontal load supports may be adopted.

Additionally, in the above embodiment, the horizontal load support is displaced in the X-axis direction by tightening the nut 61. For example, however, the rod part 57 may be displaced using a hydraulic cylinder or the like, or the rod part 57 may be displaced by other methods.

Additionally, in the above embodiment, the horizontal load support has a configuration having the link mechanism including the inner link part 34, the intermediate coupling part 35, and the outer link part 36. For example, however, a link mechanism consisting of the inner link part 34 and the intermediate coupling part 35 may be adopted, or other configurations having a pin junction part and a spherical bearing may be adopted.

Additionally, a joining part between the vacuum vessel and the horizontal load support may be joined together using welding or may be joined together via other seal structures.

Additionally, in the above embodiment, the central axis C of the superconductive coils 7 and 8 is arranged so as to run in the upward-downward direction. However, the superconductive coils 7 and 8 arranged so that the central axis C runs in the horizontal direction may be adopted, or the superconductive coils 7 and 8 arranged so that the central axis C is inclined with respect to the upward-downward direction may be adopted.

Additionally, in the above embodiment, the pin member 46 is arranged at one end of the inner link part 34, and the spherical shaft 47 is arranged at the other end of the inner link part 34. However, a configuration in which pin members are arranged at both ends of the inner link part may be adopted, or a configuration in which spherical shafts are arranged at both ends of the inner link part may be adopted. Additionally, a configuration in which the spherical shaft is arranged at one end of the inner link part and the pin member is arranged at the other end of the inner link part may be adopted. Similarly, also in the outer link part 36, the arrangement of the pin member and the spherical shaft may be appropriately changed.

It should be understood that the invention is not limited to the above-described embodiment, but may be modified into various forms on the basis of the spirit of the invention. Additionally, the modifications are included in the scope of the invention.

What is claimed is:

1. A cyclotron comprising:

a pole;

a superconductive coil wound so as to cover an outer periphery of the pole;

a coil support that supports the superconductive coil;

a cooling part that cools the superconductive coil;

a first support that is connected to the coil support and is capable of adjusting a position of the coil support in a direction of a winding central axis of the superconductive coil; and a second support that is connected to the coil support and is capable of adjusting the position of the coil support in an orthogonal direction orthogonal to the direction of the winding central axis of the superconductive coil, wherein the second support has a link mechanism that is displaceable in each of the direction of the winding central axis and the orthogonal direction.

2. The cyclotron according to claim 1, further comprising:

a fixing part that is fixed relative to the pole; and a positioning part that positions one end side of the second support with respect to the fixing part.

3. The cyclotron according to claim 1, wherein the link mechanism includes a first direction member that extends in a first direction, a pin member that is coupled to one end side of the first direction member and extends in a second direction orthogonal to the first direction, a spherical shaft that is coupled to the other end side of the first direction member, extends in the second direction, and has a spherical surface, and a spherical bearing part that has an abutting surface abutting against the spherical surface and receives the spherical shaft.

4. A superconductive electromagnet comprising:

a superconductive coil wound around a winding central axis;

a coil support that supports the superconductive coil;

a cooling part that cools the superconductive coil;

a first support that is connected to the coil support and is capable of adjusting a position of the coil support in a direction of the winding central axis of the superconductive coil; and a second support that is connected to the coil support and is capable of adjusting the position of the coil support in an orthogonal direction orthogonal to the direction of the winding central axis of the superconductive coil, wherein the second support has a link mechanism that is displaceable in each of the direction of the winding central axis and the orthogonal direction.

* * * * *